US009403212B2

(12) United States Patent
ter Maat et al.

(10) Patent No.: US 9,403,212 B2
(45) **Date of Patent: *Aug. 2, 2016**

(54) PROCESS FOR PRODUCING COMPONENTS BY POWDER INJECTION MOLDING

(75) Inventors: Johan ter Maat, Mannheim (DE); Martin Blömacher, Meckenheim (DE); Hans Wohlfromm, Mannheim (DE)

(73) Assignee: BASF SE, Luswigshafen (DE)

( * ) Notice: Subject to any disclaimer, the term of this patent is extended or adjusted under 35 U.S.C. 154(b) by 922 days.

This patent is subject to a terminal disclaimer.

(21) Appl. No.: 13/472,915

(22) Filed: May 16, 2012

(65) Prior Publication Data

US 2012/0294749 A1 Nov. 22, 2012

Related U.S. Application Data

(60) Provisional application No. 61/487,295, filed on May 18, 2011.

(51) Int. Cl.
*B22F 3/10* (2006.01)
*B22F 3/22* (2006.01)

(52) U.S. Cl.
CPC ..... *B22F 3/1021* (2013.01); *B22F 3/225* (2013.01)

(58) Field of Classification Search
CPC . B22F 2001/0066; B22F 3/225; B22F 3/1021
USPC ..... 419/54
See application file for complete search history.

(56) References Cited

U.S. PATENT DOCUMENTS

| | | | | |
|---|---|---|---|---|
| 4,197,118 | A | 4/1980 | Wiech, Jr. | |
| 5,080,846 | A | 1/1992 | Kim et al. | |
| 5,198,489 | A | 3/1993 | Sterzel et al. | |
| 5,362,791 | A | 11/1994 | Ebenhoech et al. | |
| 5,604,919 | A | 2/1997 | Sterzel et al. | |
| 5,877,270 | A * | 3/1999 | Takayama et al. | 264/344 |
| 6,051,184 | A | 4/2000 | Kankawa | |
| 2009/0288739 | A1 * | 11/2009 | Wohlfromm et al. | 148/522 |

FOREIGN PATENT DOCUMENTS

| | | | |
|---|---|---|---|
| DE | 4337129 | A1 | 8/1994 |
| DE | 19925197 | A1 | 12/1999 |
| EP | 0413231 | A2 | 2/1991 |
| EP | 0446708 | A2 | 9/1991 |
| EP | 465940 | A2 | 1/1992 |
| EP | 501602 | A2 | 9/1992 |
| WO | WO-91/07364 | A1 | 5/1991 |
| WO | WO-2008/006776 | A1 | 1/2008 |
| WO | WO-2011016718 | A1 | 2/2011 |

OTHER PUBLICATIONS

Y. Kankawa, et al., "Injection Molding of SUS316L Powder with Polyacetal Polyethylene Polymer-Alloy Polymer", Journal of the Japan Society of Powder Metallurgy, vol. 43, No. 7, (1996), pp. 840-845.

R.M. German, "Injection Molding of Metals and Ceramics", MPIF 1997, chapter 7, p. 178.

International Search Report for PCT/IB2012/052418, mailing date Sep. 27, 2012.

* cited by examiner

*Primary Examiner* — Weiping Zhu

(74) *Attorney, Agent, or Firm* — Drinker Biddle & Reath LLP

(57) ABSTRACT

Process for producing a shaped metallic body from a thermoplastic composition by injection molding or extrusion to form a shaped part, removal of the binder and sintering, wherein a thermoplastic composition composed of a metal powder and a polymer mixture $B_1$) and $B_2$) based on a polyoxymethylene homopolymer or copolymer $B_1$) is used as binder and to remove the binder a) the shaped part is treated with a solvent which extracts the binder component $B_2$) from the shaped part and in which the binder component $B_1$) is insoluble, b) the solvent is then removed from the shaped part by drying and c) the shaped part is treated thermally at from 140 to 200° C. in an oxygen-comprising atmosphere, as a result of which the binder component $B_1$) is removed from the shaped part;

and also a shaped metallic body which can be obtained in this way.

17 Claims, 1 Drawing Sheet

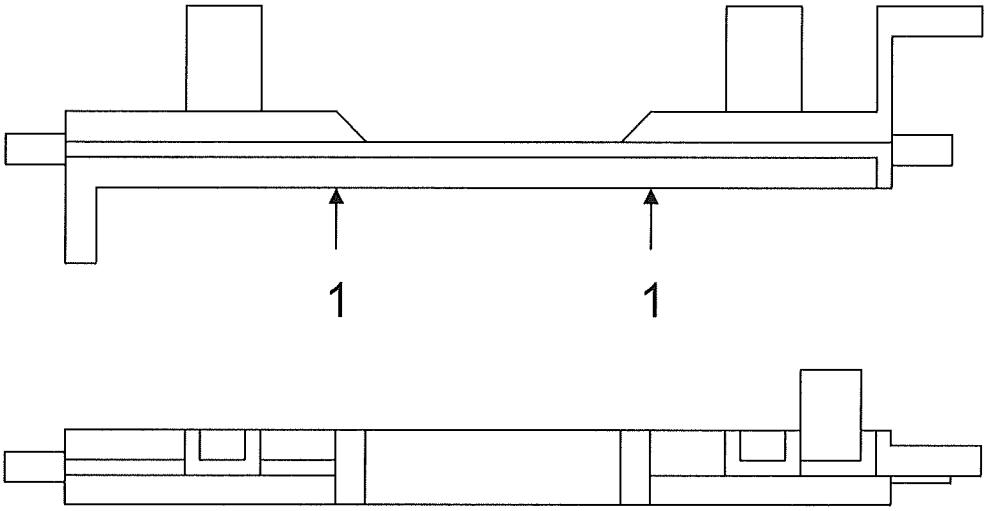
1
1

PROCESS FOR PRODUCING COMPONENTS BY POWDER INJECTION MOLDING

CROSS-REFERENCE TO RELATED APPLICATIONS

This application claims benefit (under 35 USC 119(e)) of U.S. Provisional Application 61/487,295, filed May 18, 2011, which is incorporated by reference.

The present invention relates to a process for producing shaped metallic bodies by powder injection molding and also a shaped metallic body which can be obtained in this way.

Shaped metallic bodies can be produced by injection molding of thermoplastic compositions which comprise metal powders together with an organic binder. These are highly filled organic polymer molding compositions. After injection molding, extrusion or pressing of the thermoplastic composition to give a green body, most of the organic binder is removed to give a brown body which is then sintered.

The first binders were generally based on mixtures of polyethylene or polypropylene and wax. They were firstly freed of the wax by melting out and the residual binder was burnt out in a slow pyrolysis step. To effect melting-out, the green parts have to be embedded in a powder bed because they have virtually no green strength after melting-out.

In later binder systems for thermal binder removal, the melting-out was omitted because of the time-consuming procedure.

A binder system for total thermal binder removal usually comprises a plurality of components (e.g. DE 199 25 197 A1). These components are liberated successively during heating; the more volatile components create channels for the relatively high molecular weight components which decompose only later at a higher temperature.

Both the abovementioned processes are without exception slow; the binder removal takes from 1 to 3 days. As a result of long residence in a temperature range in which the binder is slowly melted, deformation of the shaped parts under their own weight is virtually unavoidable. However, the two processes are still used in some cases.

Processes (U.S. Pat. No. 4,197,118 A, EP 0 501 602 A2) in which a binder component (e.g. waxes or polyethylene glycol) is removed by solvent extraction constitute an improvement. The remaining insoluble residual binder (e.g. polyethylene) is removed from the shaped part by thermal decomposition. This removal of residual binder generally takes from 0.5 to 1 day and is thus somewhat quicker than total thermal binder removal. The binder systems used generally comprise from about 30 to 70% by volume of the soluble polymer.

R. M. German ("Injection Molding of Metals and Ceramics", MPIF 1997, chapter 7, page 178) teaches that the lower limit for practicable removal of the soluble binder component of a multicomponent binder in binder removal by means of a solvent is 30% by volume. The soluble component frequently represents two thirds of the binder; the upper limit is given as 98%.

WO 2011/016718 A1 describes a process for producing shaped metallic or ceramic bodies, in which a molding composition is produced from a sinterable metallic or ceramic powder using a binder mixture of a polymer such as polyoxymethylene (POM or polyacetal) and a nonpolymeric solvent for the polymer (molar mass <300 g/mol, melting point >RT). The binder preferably comprises at least 5% by weight of each of the polymer and the nonpolymeric solvent. The nonpolymeric solvent is evaporated (e.g. at from 69 to 130° C.) or can be dissolved out of the molding composition or diluted using a further solvent. The remaining polymer is removed by thermal binder removal, preferably at above 200° C. In the examples with a metal powder, POM as binder component together with caprolactam (proportions by weight 50:50), only 2-stage thermal binder removal with evaporation of the solvent at from 69 to 130° C. and thermal binder removal at ≥240° C. is disclosed.

A disadvantage of this process is that such binders lose the nonpolymeric solvent by evaporation during mixing with the sinterable powder and processing on the injection molding machine. The low molecular weight component is sweated out at the surface of the green part and contaminates the injection molding tool. In addition, the strength of the green part is significantly reduced.

In a further process for producing shaped metallic or ceramic parts, a binder component (generally polyoxymethylene) is firstly removed catalytically from the molding composition and a further remaining binder component of an acid-stable polymer is then removed thermally. The catalytic binder removal can be carried out by treating the molding composition in a gaseous, acid-comprising atmosphere at elevated temperature. Here, for example, polyoxymethylene homopolymers or copolymers are depolymerized without leaving a residue. The remaining binder component, whose residual binder content is only 10% of the amount of binder initially present, is then removed thermally at 250-500° C. over a period of from about 3 to 6 hours.

Suitable binder systems for the abovementioned processes with acid-catalyzed and thermal binder removal for producing shaped metallic or ceramic bodies are, for example, binder systems comprising a mixture of polyoxymethylene homopolymers or copolymers (=POM) and a polymer which is not miscible therewith, e.g. polyolefins, in particular polyethylene and polypropylene, or else polymers of methacrylic esters, e.g. PMMA (EP 0 465 940 A1). Further suitable binder systems comprise a polymer system composed of polytetrahydrofuran and at least one polymer from among $C_{2-8}$-olefins, vinylaromatic monomers, vinyl esters of aliphatic $C_{1-8}$-carboxylic acids, vinyl-$C_{1-8}$-alkyl ethers or $C_{1-12}$-alkyl (meth)acrylates (DE 100 19 447 A1) or a polymer system composed of $C_{2-8}$-olefins and poly-1,3-dioxepane or poly-1,3-dioxolane (WO 2008/006776 A1) as further binder component in addition to POM.

Completely thermal binder removal is also described in the case of polyoxymethylene binders for the example of ceramic powders at temperatures of from 160 to 220° C. in the presence of air or at from 300 to 360° C. in the presence of nitrogen (U.S. Pat. No. 5,080,846 A and WO 91/07364 A1).

Y. Kankawa (Journal of the Japan Society of Powder Metallurgy 43/7 (1996) 840 to 845, reports a study on thermal binder removal from a metal powder (SUS316L) with, inter alia, polyacetal as binder component in air at from 300 to 320° C.

As indicated above, purely thermal binder removal is very slow and deformation of the shaped bodies occurs very frequently since the temperatures of the metallic molding compositions during thermal binder removal (>200° C.) are in a temperature range far above the melting range of polyacetal (160 to 170° C.).

Furthermore, thermal binder removal in an oxygen-comprising atmosphere represents a problem when using metal powders, in contrast to ceramic powders, because the powder surface is generally oxidized during the operation and the quality and integrity of the sintered shaped part is therefore impaired.

It is therefore an object of the present invention to provide an improved process for producing shaped metallic bodies which does not have the abovementioned disadvantages.

The object is achieved by the inventive process according to claim 1.

It has surprisingly been found that it is possible to obtain shaped metallic bodies having improved quality and integrity by a combination of binder removal by means of a solvent with subsequent thermal residual binder removal in an oxygen-comprising atmosphere from molding compositions comprising metal powder and polyacetal-based binder systems.

The invention provides a process for producing a shaped metallic body from a thermoplastic composition by injection molding or extrusion to form a shaped part, removal of the binder and sintering, wherein a thermoplastic composition comprising A) from 40 to 65% by volume of at least one sinterable metal powder A, B) from 35 to 60% by volume of a mixture of $B_1$) from 50 to 95% by weight of one or more polyoxymethylene homopolymers or copolymers;

$B_2$) from 5 to 50% by weight of a polymer selected from among aliphatic polyurethanes, aliphatic uncrosslinked polyepoxides, polyethers, aliphatic polyamides, polyacrylates and mixtures thereof which is homogeneously dissolved or dispersed with an average particle size of less than 1 μm in $B_1$)

as binder and

C) from 0 to 5% by volume of a dispersant, where the sum of the components A), B) and C) does not exceed 100% by volume, is used;

and to remove the binder a) the shaped part is treated with a solvent which extracts the binder components $B_2$) and optionally C) from the shaped part and in which the binder component $B_1$) is insoluble, b) the solvent is then removed from the shaped part by drying and c) the shaped part is treated thermally at 140-200° C., preferably 140-170° C., in an oxygen-comprising atmosphere, as a result of which the binder component $B_1$) is removed to an extent of at least 20% by weight, preferably at least 50% by weight, very particularly preferably at least 85% by weight, from the shaped part.

BRIEF DESCRIPTION OF THE FIGURE

FIG. 1 illustrates the side view at top, plan view of the component at the bottom.

A DETAILED DESCRIPTION OF THE INVENTION

The polyoxymethylene homopolymers or copolymers (POM) are known as such and are commercially available. The homopolymers are usually prepared by polymerization of formaldehyde or trioxane, preferably in the presence of suitable catalysts. Polyoxymethylene copolymers which are preferred for the purposes of the invention likewise comprise trioxane and other cyclic or linear formals or other formaldehyde sources as main monomers. The term main monomers is intended to indicate that the proportion of these monomers in the total amount of monomers, i.e. the sum of main monomers and comonomers, is greater than the proportion of the comonomers in the total amount of monomers. Quite generally, such POM polymers have at least 50 mol % of recurring —$CH_2O$— units in the main polymer chain. Suitable polyoxymethylene copolymers are described in EP-A 0 446 708 (page 3, line 39 to page 4, line 31).

The proportion of component $B_1$) is preferably from 65 to 85% by weight, based on the total amount of the binder B).

The proportion of component $B_2$) is preferably from 15 to 35% by weight, based on the total amount of the binder B).

As component $B_2$), use is made of polymers selected from among aliphatic polyurethanes, aliphatic uncrosslinked polyepoxides, polyethers, aliphatic polyamides, polyacrylates and mixtures thereof. The abovementioned polymers $B_2$) are likewise described in EP-A 0 446 708 (page 4, line 34 to page 7, line 12).

Among the abovementioned polymers $B_2$), particular preference is given to polyethers, in particular poly($C_2$-$C_6$)-alkylene oxides such as polyethylene oxide (PEO), polypropylene oxide, poly-1,3-dioxepane (PDX), poly-1,3-dioxane, poly-1,3-dioxolane, polytetrahydrofuran (PTHF) and/or mixtures thereof, preferably having average molecular weights (weight average) in the range from 600 to 100 000 g/mol, particularly preferably from 2000 to 50 000 g/mol. Such products are commercially available or the corresponding production processes proceed similarly to those described for polyoxymethylene copolymers and are known to those skilled in the art, so that further information is superfluous here. It is also possible to use mixtures of various polyethers and/or of polyethers of different molecular weights.

For the purposes of the present invention, sinterable metal powders A are metal powders, metal alloy powders, carbonyl metal powders and/or mixtures thereof.

As metals which can be present in powder form, mention may be made by way of example of aluminum, iron, in particular carbonyl iron powder, chromium, cobalt, copper, nickel, silicon and titanium. As pulverulent metal alloys, mention may be made by way of example of high- or low-alloy steels and also metal alloys based on aluminum, iron, titanium, copper, nickel, tungsten or cobalt. It is possible to use both powders of finished alloys and powder mixtures of the individual alloy constituents.

The particle sizes of the powders are preferably from 0.1 to 50 μm, particularly preferably from 0.3 to 30 μm.

The dispersant which is optionally present as component C) can be selected from among known dispersants. Examples are oligomeric polyethylene oxide having an average molecular weight of from 200 to 600, stearic acid, stearamide, hydroxystearic acid, fatty alcohols, fatty alcohol sulfonates and block copolymers of ethylene oxide and propylene oxide, and also polyisobutylene.

In addition, the thermoplastic compositions can also comprise customary additives and processing aids which favorably influence the rheological properties of the mixtures during shaping.

The production of the thermoplastic composition used in the process of the invention can be carried out in a customary manner in a kneader or extruder at temperatures of from 150 to 200° C. (cf. EP-A-0 413 231). After cooling of the composition, this can be pelletized. In a preferred embodiment, the thermoplastic composition to be shaped can be produced by melting the component B) and mixing in the components A) and optionally C). For example, the component B) can be melted in a twin-screw extruder at temperatures of preferably from 150 to 220° C., in particular from 170 to 200° C. The component A) is subsequently metered in the required amount into the stream of melt of the component B) at temperatures in the same range. The component A) preferably comprises the dispersant or dispersants C) on the surface. However, the thermoplastic compositions can also be produced by melting the components B) and C) in the presence of the component A) at temperatures of from 150 to 220° C.

The shaping of the thermoplastic molding composition by injection molding can be carried out using conventional screw and ram injection molding machines. Shaping is generally carried out at temperatures of from 175 to 200° C. and pressures of from 3000 to 20 000 kPa in molds having a temperature of from 60 to 140° C.

The green bodies removed from the mold are then treated with a solvent according to step a) of the process of the invention. Here, the choice of the solvent is based on the chemical nature of the binder component $B_2$). Purely by way of example, solvents for some binder components $B_2$) are indicated below; the solvents for other binder components $B_2$) should be known to those skilled in the art. Mixtures of suitable solvents can also be used.

Polyacrylates (e.g. PMMA) and polyamides are generally soluble in the following solvents: ethers such as diethyl ether or tetrahydrofuran, ketones such as methyl ethyl ketone or acetone, esters such as butyrolactone and $C_1$-$C_4$-alcohols such as ethanol.

Polyethers such as polytetrahydrofuran, poly-1,3-dioxepane, poly-1,3-dioxolane, polyethylene oxide or polypropylene oxide can, for example, be dissolved in solvents such as tetrahydrofuran or acetone and in $C_1$-$C_6$-alcohols such as ethanol and isopropanol; polyethylene oxide can also be dissolved in water.

The treatment of the shaped part with a solvent according to step a) of the process of the invention can be carried out in commercially available plants having a closed solvent circuit for the cleaning of machined workpieces contaminated with lubricants, for example as described in DE-A 43 371 29. To accelerate the dissolution process, step a) is preferably carried out at elevated temperature, i.e. a temperature above room temperature up to the boiling point of the solvent, in particular at a temperature of from 40 to 120° C. Step a) is particularly preferably carried out at the boiling point of the solvent under reflux.

The polyoxymethylene homopolymers and copolymers (POM) used as binder component $B_1$) or residual binder for step a) of the process of the invention are resistant to virtually all customary solvents at up to 120° C. and still guarantee a very high strength even at temperatures higher than 120° C.

It is advantageous for there to be a large concentration difference between the soluble binder component $B_2$) in the shaped part and in the solvent during the extraction in step a) of the process of the invention. This can be achieved by frequently replacing the loaded solvent by fresh solvent and/or quickly carrying away the dissolved extract from the surface of the goods being extracted, for example by circulation.

The treatment with a solvent according to step a) of the process of the invention is preferably carried out until the binder component $B_2$) has been removed to an extent of at least 75% by weight, preferably 85% by weight, particularly preferably 90% by weight, from the shaped part. This state is generally reached after from 4 to 48 hours. The required treatment time depends on the treatment temperature, on the effectiveness of the solvent for the binder component $B_2$), on the molecular weight of the component $B_2$) and on the size of the shaped body.

After the extraction (step a), the green parts, which are now porous and saturated with solvent, have to be dried. Drying of the shaped part is preferably carried out in a conventional way, for example by means of a vacuum drying oven, an oven or a convection oven, in step b) of the process of the invention. However, drying can also advantageously be integrated into step c) of the process of the invention. In this case, both drying and the thermal residual binder removal can be carried out in the same plant, for example in a convection oven, as a result of which transfer of the shaped parts between drying and thermal binder removal is not necessary.

The solvent is preferably removed in a separate step b). Here, the drying temperature is guided by the boiling point of the solvent but is preferably selected somewhat lower in order to avoid the risk of sudden or excessively rapid drying with possible adverse consequences for the quality of the green part. Drying according to step b) of the process of the invention is usually concluded in from 0.5 to 8 hours.

The thermal binder removal c) in the process of the invention takes place in an oven in which the green bodies are subjected to a suitable temperature in the range from 140 to 200° C. in an oxygen-comprising atmosphere for a defined period of time. The construction and materials of the oven have to ensure that the temperature is uniform over the entire volume of the oven and good heat transfer to the shaped parts from which binder is to be removed is achieved. In particular, cold places in the interior of the oven are to be avoided so as to prevent condensation of decomposition products. For the purposes of the present invention, an oxygen-comprising atmosphere is a gas mixture composed of an inert gas such as nitrogen or argon and from 1 to 100% by volume of oxygen, with preference being given to air. In batch ovens, internals or circulation elements which ensure uniform distribution and swirling of the oven atmosphere so that all shaped bodies are subject to virtually identical temperature conditions are known from the prior art.

A preferred oven is a conventional convection oven for heat treatments. Particularly at relatively high loadings of the oven, a sufficient fresh gas supply (at least ten-fold replacement) is necessary in addition to swirling of the gas so that the decomposition product formaldehyde is sufficiently diluted (<4% by volume) and the oven is thus kept in a safe operating state since, for example, air/formaldehyde mixtures are ignitable.

The thermal residual binder removal according to step c) of the process of the invention is carried out until the binder component $B_1$) has been removed to an extent of at least 20% by weight, preferably 50% by weight, particularly preferably 85% by weight, from the shaped part.

It can be desirable not to remove the entire amount of polyacetal present thermally since the components from which the binder has been removed usually have to be transferred to another furnace for sintering and the strength of the shaped part can then be insufficient. In such cases, the removal of only from 20 to 50% of the maximum amount of the binder component $B_1$) can be more useful; the remaining, stabilizing residue can then be removed thermally in the sintering furnace using an appropriate cycle.

The shaped metal bodies obtained by the process of the invention are oxidized only on the surface as a result of the low temperatures used in the thermal removal of binder in comparison with the prior art and have better quality and integrity than shaped metal bodies produced according to the prior art.

The invention is illustrated below with the aid of examples.

In the following examples, test compositions were mixed in a cone mixer and homogenized and pelletized in a laboratory extruder heated to 190° C.

Example 1

Molding composition 1 had the following composition:

56.75% by volume of a mixture of 98% by weight of carbonyl iron powder and 2% by weight of carbonyl nickel powder 43.25% by volume of binder comprising 90% by weight of polyoxymethylene with 2 mol % of 1,3-dioxepane 10% by weight of polyethylene oxide (PEO) having a molar mass of 2000 and end-capped by methylation Example 2

Molding composition 2 had the following composition:

56.75% by volume of a mixture of 98% by weight of carbonyl iron powder and 2% by weight of carbonyl nickel powder 43.25% by volume of binder comprising 80% by weight of polyoxymethylene with 2 mol % of 1,3-dioxepane 20% by weight of polyethylene oxide (PEO) having a molar mass of 2000 and end-capped by methylation Example 3

Molding composition 3 had the following composition:

56.75% by volume of a mixture of 98% by weight of carbonyl iron powder and 2% by weight of carbonyl nickel powder 43.25% by volume of binder comprising 50% by weight of polyoxymethylene with 2 mol % of 1,3-dioxepane 50% by weight of polyethylene oxide (PEO) having a molar mass of 2000 and end-capped by methylation Example 4

Molding composition 4 had the following composition:

56.75% by volume of a mixture of 98% by weight of carbonyl iron powder and 2% by weight of carbonyl nickel powder 43.25% by volume of binder comprising 90% by weight of polyoxymethylene with 2 mol % of 1,3-dioxepane 10% by weight of polytetrahydrofuran (PTHF) having a molar mass of 2000

Example 5

Molding composition 5 had the following composition:

64% by volume of a metal powder having the composition 17-4 PH (DIN 1.4542) and an average particle size of 7 μm 36% by volume of binder comprising 80% by weight of polyoxymethylene with 2 mol % of 1,3-dioxepane 20% by weight of poly-1,3-dioxepane (PDX) having a molar mass of 34 000.

Injection Molding Tests on Real Components

The examination of the general suitability of the test compositions was carried out using a complex and heavy component, viz. a hinge of complex geometry fed using two film gates at the positions 1 (FIG. 1: side view at top, plan view of the component at bottom).

The length of the component was 100 mm, and the weight of the sintered part obtained was about 34 g for the metal powder examples 1 to 5.

This ensures that the results of the experiments are also relevant to practice since the intrinsic weight of this component makes above-average demands on the strength after binder removal.

Examination of Processing on the Injection Molding Machine

The test compositions were melted in the barrel of the injection molding machine at 190° C., and the injection molding tool was maintained at 135° C. In general, the injection pressure required was about 1900 bar; only in the case of test composition 3 having a high PEO content and the low molar mass of 2000 was it possible to work at 1100 bar.

The test compositions differed in the cooling time required before removal from the mold. The test compositions having a higher proportion of second binder (30% and above) were somewhat softer and required a longer cooling time to be able to demold the green part intact; the green parts also display somewhat greater streaking on the surface. The test composition 3 having a PEO content of 50% had to be removed from the mold and handled more carefully because of the lower green strength and is therefore considered to be the upper limit for binder component $B_2$).

All test compositions could be processed without particular problems.

Examination of Binder Removal and Sintering

The green parts produced from the test compositions were pretreated in a solvent and the shaped part was then subjected to thermal removal of residual binder and sintered.

For the binder removal by means of a solvent, the green parts were treated in boiling acetone under reflux in a stirred three-neck flask. Green parts of examples 1 to 4 were taken out after storage in the solvent for 7 h, 14 h, 21 h and 28 h, dried and weighed. The green parts corresponding to example 5 were only reweighed at the end of storage (28 h).

Table 1 shows the results for weight loss as a percentage of theory in the primary binder removal by means of solvent using acetone:

TABLE 1

| Example | Metal powder | Composition of binder (% by weight) | Weight loss of the shaped part (% of theory) 7 h Acetone | 14 h Acetone | 21 h Acetone | 28 h Acetone |
|---|---|---|---|---|---|---|
| 1 | Fe/Ni | POM - 10% of PEO 2000 | 59 | 77 | 84 | 89 |
| 2 | Fe/Ni | POM - 20% of PEO 2000 | 70 | 85 | 92 | 95 |
| 3 | Fe/Ni | POM - 50% of PEO 2000 | 71 | 85 | 94 | 97 |
| 4 | Fe/Ni | POM -10% of PTHF 2000 | 69 | 81 | 85 | 88 |
| 5 | 17-4PH | POM -20% of PDX 34000 | | | | 90 |

It can be seen that the maximum binder removal rate in the boiling solvent is achieved at a binder content of only 20% by weight of the component $B_2$); example 3 with the highest PEO content is not significantly faster in respect of the dissolution process. Even at 10% by weight of the component $B_2$) (example 1), the removal is astonishingly quick.

The subsequent thermal binder removal from the shaped parts was carried out in a 50 l air convection oven at temperatures up to max. 170° C.; the oven was flushed with 500 l/h of air. The following heating program was used:

| Stage | $T_1$ [° C.] | $T_2$ [° C.] | Heating rate [° C./h] | Residence time at $T_2$ [h] |
|---|---|---|---|---|
| 0 | RT | 130 | 300 | 1 |
| 1 | 130 | 140 | 10 | 6 |
| 2 | 140 | 150 | 10 | 16 |
| 3 | 150 | 160 | 10 | 1 |
| 4 | 160 | 170 | 10 | 1 |
| 5 | 170 | 170 | — | 5 |
| 6 | 170 | 170 | — | 39 |

As comparative examples 1 and 2, green parts which had a composition according to examples 1 and 5, respectively, and had not been subjected to preliminary binder removal by means of a solvent were also subjected to thermal binder removal. The values for the weight loss of polyoxymethylene from the shaped part achieved by means of the abovementioned heating program are shown in table 2. In the last column, the theoretically achievable weight loss calculated from the polyoxymethylene content is reported.

TABLE 2

| | | Weight loss [%] | | | | | | |
|---|---|---|---|---|---|---|---|---|
| Example | Metal | 140° C. 6 h | 150° C. 16 h | 160° C. 1 h | 170° C. 1 h | 170° C. 5 h | 170° C. 39 h | Theory [%] |
| 1 | Fe/Ni | 3.4 | 6.9 | 7.9 | 9.3 | 10.8 | 10.7 | 10.9 |
| 2 | Fe/Ni | 3.8 | 6.9 | 7.8 | 8.8 | 9.8 | 9.7 | 10.0 |
| 3 | Fe/Ni | 2.9 | 5.5 | 6.1 | 7.2 | 7.8 | 7.6 | 7.9 |
| 4 | Fe/Ni | 3.2 | 6.5 | 7.8 | 9.3 | 10.8 | 10.7 | 10.9 |
| 5 | 17-4PH | 1.4 | 2.1 | 2.3 | 4.1 | 6.3 | 7.3 | 7.4 |
| Comp. 1 | Fe/Ni | — | — | — | — | 0.2 | 10.3 | 10.9 |
| Comp. 2 | 17-4PH | — | — | — | 0.1 | 0.7 | 7.1 | 7.4 |

Without removal of binder by means of a solvent (see comparative examples 1 and 2), the degradation of the polyoxymethylene starts slowly at 170° C. In the case of shaped parts which have firstly been subjected to preliminary binder removal by means of a solvent and subsequent thermal binder removal according to the process of the invention (see examples 1-5), the thermal removal of binder in air commences at about 140° C. This effect is particularly surprising because the polyoxymethylene is not yet molten at this temperature. This results in a considerable technical advantage because the usual plastic deformation described above as a result of melting of the residual binder before the actual thermal decomposition cannot take place at all.

All green parts which have been subjected to preliminary binder removal by means of a solvent were defect-free but slightly oxidized on the surface after the thermal residual binder removal in air. The slight surface oxidation was shown by a brown coloration of the shaped parts according to examples 1 to 4 and by a green cast on the shaped part according to example 5 and also by an increase in weight of the shaped parts according to examples 1 to 4 from heating stage 5 to heating stage 6. The thermal removal of binder from the green parts which had been subjected to preliminary binder removal is essentially concluded after heating stage 5.

In contrast, the green parts which had not been subjected to preliminary binder removal by means of a solvent as per comparative examples 1 and 2 displayed typical serious defects such as surface blisters and even cracks at the relatively thick places after the approximately complete thermal binder removal in heating stage 6.

The shaped parts according to examples 1 and 4 obtained after the process of the invention were sintered after heating stage 5 in a 30 l sintering furnace with molybdenum lining and molybdenum heating elements under hydrogen of the grade 4.8 in the decimal notation. The strength after complete binder removal was sufficient for transfer; the shaped parts could also be handled.

The sintering curve was as follows:

from room temperature to 600° C. at 5° C./min
hold time at 600° C.: 1 h
from 600° C. to 1280° C. at 5° C./min
hold time at 1280° C.: 1 h
cooling at 5° C./min to 1000° C.
furnace off, natural cooling.

This sintering program made it possible to achieve a good sintered density of at least 7.60 g/cm$^3$ for all molding compositions according to examples 1 to 4. The oxidation observed after the thermal removal of residual binder was completely reduced and the sintered parts were shiny.

The shaped parts according to example 5 obtained after the process of the invention were likewise sintered after heating stage 5 in the same sintering furnace under hydrogen of the grade 4.8. The sintering curve was as follows:

from room temperature to 600° C. at 5° C./min
hold time at 600° C.: 1 h
from 600° C. to 1380° C. at 5° C./min
hold time at 1380° C.: 1 h
cooling at 5° C./min to 1000° C.
furnace off, natural cooling.

Here too, it was possible to obtain intact, shiny sintered parts as long as the components from which 85% of the binder had been removed and which had only a very low strength did not have to be touched before sintering. The sintered parts achieved a good sintered density of 7.68 g/cm$^3$.

A further experiment was carried out on the green parts according to example 5 which had been subjected to preliminary binder removal by means of a solvent.

The green parts which had been subjected to preliminary binder removal in the solvent were subjected to thermal binder removal at 140° C. in air for 16 hours. The weight loss was then 2.2%, i.e. 30% of the maximum value. These shaped parts from which part of the binder had been removed now had a strength sufficient for charging and were no longer visibly oxidized. The sintering of these shaped parts was carried out using a customary, somewhat slower temperature program for the sintering of shaped parts comprising 10% of residual binder under hydrogen of the grade 4.8:

from room temperature to 450° C. at 3° C./min
hold time at 450° C.: 1 h
from 450° C. to 600° C. at 3° C./min
hold time at 600° C.: 1 h
from 600° C. to 1380° C. at 5° C./min
hold time at 1380° C.: 1 h
cooling at 5° C./min to 1000° C.
furnace off, natural cooling.

The sintered parts were shiny, defect-free and achieved a virtually identical final density of 7.66 g/cm$^3$.

The invention claimed is:

1. A process for producing a shaped metallic body which comprises injection molding or extruding a thermoplastic composition to form a shaped part, removal of the binder and sintering, wherein a thermoplastic composition comprising A) from 40 to 65% by volume of at least one sinterable metal powder A, B) from 35 to 60% by volume of a binder mixture consisting of $B_1$) from 50 to 95% by weight of one or more polyoxymethylene homopolymers or copolymers;

$B_2$) from 5 to 50% by weight of a polymer selected from among aliphatic polyurethanes, aliphatic uncrosslinked polyepoxides, polyethers, aliphatic polyamides, polyacrylates and mixtures thereof which is homogeneously dissolved or dispersed with an average particle size of less than 1 μm in $B_1$) and C) from 0 to 5% by volume of a dispersant, where the sum of the components A), B) and C) does not exceed 100% by volume, is used;

and to remove the binder a) the shaped part is treated with a solvent which extracts the binder components $B_2$) and optionally C) from the shaped part and in which the binder component $B_1$) is insoluble, b) the solvent is then removed from the shaped part by drying and c) the shaped part is treated thermally at 140-200° C. in an oxygen-comprising atmosphere, as a result of which the binder component $B_1$) is removed to an extent of at least 20% by weight from the shaped part.

2. The process according to claim 1, wherein the proportion of the binder component $B_2$) is from 15 to 35% by weight.

3. The process according to claim 2, wherein the binder component $B_2$) is a polyether selected from the group consisting of polyethylene oxide, polypropylene oxide, poly-1,3-dioxepane, poly-1,3-dioxane, poly-1,3-dioxolane, polytetrahydrofuran (poly(tetramethylene) oxide) and mixtures thereof.

4. The process according to claim 3, wherein step a) is carried out at a temperature above room temperature up to the boiling point of the solvent.

5. The process according to claim 4, wherein the treatment with a solvent in step a) is carried out until the binder component $B_2$) has been removed to an extent of at least 75% by weight from the shaped part.

6. The process according to claim 5, wherein the thermal treatment in step c) is carried out in a convection oven.

7. The process according to claim 6, wherein the thermal treatment in step c) is carried out at 140-170° C.

8. The process according to claim 7, wherein the thermal treatment in step c) is carried out until the binder component $B_1$) has been removed to an extent of at least 85% by weight from the shaped part and the treatment with a solvent in step a) is carried out until the binder component $B_2$) has been removed to an extent of at least 85% by weight from the shaped part.

9. The process according to claim 1, wherein the binder component $B_2$) is a polyether selected from the group consisting of polyethylene oxide, polypropylene oxide, poly-1,3-dioxepane, poly-1,3-dioxane, poly-1,3-dioxolane, polytetrahydrofuran (poly(tetramethylene) oxide) and mixtures thereof.

10. The process according to claim 1, wherein step a) is carried out at a temperature above room temperature up to the boiling point of the solvent.

11. The process according to claim 1, wherein the treatment with a solvent in step a) is carried out until the binder component $B_2$) has been removed to an extent of at least 75% by weight from the shaped part.

12. The process according to claim 1, wherein the thermal treatment in step c) is carried out in a convection oven.

13. The process according to claim 1, wherein the thermal treatment in step c) is carried out at 140-170° C.

14. The process according to claim 1, wherein the thermal treatment in step c) is carried out until the binder component $B_1$) has been removed to an extent of at least 50% by weight from the shaped part.

15. The process according to claim 1, wherein the thermal treatment in step c) is carried out until the binder component $B_1$) has been removed to an extent of at least 85% by weight from the shaped part.

16. The process according to claim 1, wherein the treatment with a solvent in step a) is carried out until the binder component $B_2$) has been removed to an extent of at least 85% by weight from the shaped part.

17. The process according to claim 1, wherein the thermoplastic composition consists of components A), B), and C).

* * * * *